United States Patent [19]

Yokota et al.

[11] Patent Number: 4,591,879

[45] Date of Patent: May 27, 1986

[54] WINDING MECHANISM FOR TAPE-LIKE WEB

[75] Inventors: Yuuji Yokota, Iwate; Hiroshi Kajiya, Tokyo; Kazuhiro Karuishi, Iwate, all of Japan

[73] Assignee: Kabushiki Kaisha Sato, Japan

[21] Appl. No.: 688,501

[22] Filed: Jan. 2, 1985

[30] Foreign Application Priority Data

Jan. 28, 1984 [JP] Japan ..... 59-12826
Mar. 16, 1984 [JP] Japan ..... 59-49251

[51] Int. Cl.[4] ..... B415 35/08

[52] U.S. Cl. ..... 346/76 PH; 400/234; 242/75.41; 346/105

[58] Field of Search ..... 346/76 PH, 105; 219/216; 400/120, 234; 242/75.4, 75.41, 75.5, 192, 196, 202, 204; 101/DIG. 21

[56] References Cited

U.S. PATENT DOCUMENTS 3,809,336 5/1974 Kollar et al. ..... 242/202
4,000,804 1/1977 Zaltieri ..... 400/234
4,017,036 4/1977 Bates ..... 242/75.5

*Primary Examiner*—E. A. Goldberg
*Assistant Examiner*—A. Evans
*Attorney, Agent, or Firm*—Ostrolenk, Faber, Gerb & Soffen

[57] ABSTRACT

The disclosure concerns a winding mechanism for a rolled tape-like web, like a composite label or tag web or a carbon ribbon, for eliminating the slackening or meandering of the web. The web is fed from a feed reel to a take-up reel. The take-up reel drives the feed reel to rotate in a first direction by drawing the web off the feed reel. A belt also connects the take-up reel and the feed reel so that rotation of the take-up reel for winding the web onto it is transmitted by the belt to the feed reel to urge the feed reel to rotate in the direction opposite that direction of rotation of the feed reel for feeding the web off the feed reel. This tightens the web, but it is not a sufficient retarding force to prevent feeding of the web. In one embodiment, the belt connection is by a helical coiled spring belt. A spring-operated brake is positioned at the feed reel or at both of the feed and take-up reels for preventing overrunning of these reels.

16 Claims, 7 Drawing Figures

WINDING MECHANISM FOR TAPE-LIKE WEB

BACKGROUND OF THE INVENTION

I. Field of the Invention

This invention relates to an improved winding mechanism for tape-like webs, particularly a carbon ribbon, or the like. More particularly, the invention relates to an improved winding mechanism for rolled tapelike webs such as composite label webs, composite tag webs and carbon ribbons, which mechanism avoids the slackening, stretching and meandering that occurs with a tape-like web when it is wound from a feeding section to a winding section of the winding mechanism.

II. Description of the Prior Art

A tape-like web, such as a carbon ribbon, is fed from a feeding section, and usually from a feed reel in that section, to a winding section and usually to a winding take-up reel in the latter section. In a mechanism for preventing a tape-like web from slackening, for example, in a conventional label printing machine, or the like, only the feeding section is provided with a braking device. As the feeding section and the winding section are independently driven, when the winding section is driven intermittently, slackening of the tape-like web is caused by the inertia of a delivery or feed roll in the feeding section, so that a constant braking action in the feeding section cannot be produced. Such intermittent driving occurs with a carbon ribbon, for example when the feeding of the carbon ribbon is abruptly stopped for a short time, during the printing or cutting of the web, by a short stoppage of the intermittent driving by a stepping motor that is installed in the winding section.

The rotation of the rolled tape-like web in the feeding section is subjected to braking action under sliding friction. However, when a rolled tape-like web is moved intermittently, the web is moved forward excessively to some extent toward the winding section due to the inertia of the rolled tape-like web. This causes slackening or meandering of the tape-like web.

Furthermore, in a conventional thermal printer having a thermo-sensitive carbon ribbon, printing strokes sometimes occur in transversely biased side portions on the ribbon, i.e., one-sided printing strokes. In that case, slackening of the carbon ribbon is caused by the elongation or contraction of the carbon ribbon during the feeding, and this results in creasing and meandering of the carbon ribbon.

Furthermore, when a web of labels or tags, that are passed together with the carbon ribbon in layers through printing means, is damaged during the printing step, the carbon ribbon and the web of labels or tags must be set again by turning off a printing head or by separating a platen roller. Because the carbon ribbon is moved for a long time in contact with the printing head, the ribbon is attracted to the parts near the printing head by static electricity, causing slackening of the carbon ribbon. When a proper braking action has not been applied to the carbon ribbon, movement of the ribbon is started while the ribbon is slack and there is consequent meandering of the carbon ribbon. If the carbon ribbon has meandered, it has moved aside, and transverse side portions of the labels or tags cannot be printed.

SUMMARY OF THE INVENTION

In view of the foregoing, it is a principal object of the present invention to provide an improved meander preventing winding mechanism for a tape-like web, such as a carbon ribbon, which is free from the foregoing disadvantages.

Another object of the present invention is to provide an improved winding mechanism for a tape-like web, which avoids slackening and stretching of the tapelike web.

Another object of the present invention is to provide an anti-meander winding mechanism for a carbon ribbon, which avoids slackening of the carbon ribbon due to excess feeding of the ribbon caused by the inertia of the rolled carbon ribbon and due to the attraction of the ribbon caused by static electricity.

A related object is to avoid the slackening by applying back tension in the direction reverse to the feeding direction of the carbon ribbon.

A further object of the present invention is to provide an anti-meander winding mechanism for a carbon ribbon, with which mechanism the carbon ribbon is moved forward under proper tension to avoid the slackening and meandering, thereby attaining clear and accurate printing on labels and tags.

A further object of the present invention is to provide an improved winding mechanism for a tape-like web, such as a carbon ribbon, which mechanism is simple and compact in structure, easy to manufacture, and smooth and durable in operation.

According to the present invention, the improved winding mechanism for a tape-like web includes transmitting means to tansmit force to the feeding section, which force is in the direction reverse to the direction of the feeding of the tape-like web toward the winding section, and the winding mechanism also includes a braking device in which braking members are urged to each other by spring force. In one embodiment, the braking device is installed in the feeding section. In another embodiment, each of the feeding section and the winding section is provided with a respective braking device.

In one embodiment of the present invention, the transmitting means comprises a belt acting between the feed and take-up reels. In another embodiment of the present invention, the anti-meander winding mechanism transmitting means includes an elastic helical spring belt that is stretched to act between the winding reel and the feeding reel, and these reels are respectively installed in the winding section and the feeding section.

Other objects and features of the invention are described in connection with embodiments thereof with reference to the accompanying drawings.

DESCRIPTION OF THE PREFERRED EMBODIMENTS

Figure 1:
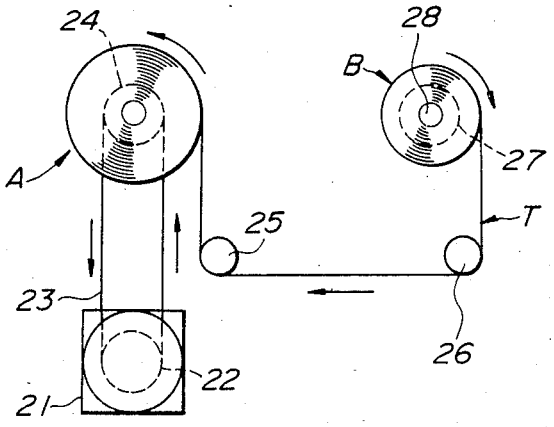
FIG. 1 Prior Art
FIG. 1 is a schematic front elevational view of an anti-slackening mechanism in the prior art.
Figure 2:
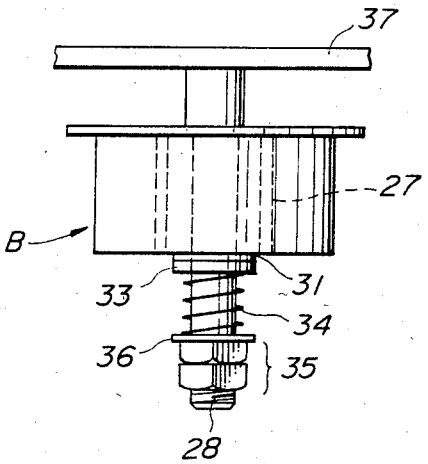
FIG. 2 Prior Art
FIG. 2 is an enlarged plan view of the feeding section of the prior art mechanism shown in FIG. 1.

For reference purpose, a known anti-slackening mechanism for a tape-like web is described with reference to FIGS. 1 and 2.

A feeding section B is provided with a tape-like web T that is wound on a feeding reel 27. A winding section A is provided with a winding reel 24. The feeding section B and winding section A are interconnected only by the tape-like web T which passes the turning shafts 25 and 26. The winding reel 24 of the winding section A is driven by a rotor 22 of the motor 21 through a belt 23.

The rotation of the rolled tape-like web T in the feeding section B is subjected to braking action due to sliding friction between a friction member 31 and the washer 33. The friction member 31 and the washer 33 are biased into pressure-contact under the force of a spring 34 that is interposed between the washer 33 and the flange 36 of a double nut 35 that is threaded to the shaft 28 of the feeding reel 27. A fixing plate 37 supports the feeding reel 27 which carries the tape-like web T on it.

However, when the tape-like web T is moved intermittently, the rolled web is moved excessively forward and is fed to some extent toward the winding section A due to the inertia of the rolled tape-like web, and this causes slackening and meandering of the tape-like web.

Furthermore, slackening and meandering of a carbon ribbon, in a conventional thermal printer having a carbon ribbon, is also caused by biased or one-sided printing strokes.

A first embodiment of the present invention is now described with reference to FIGS. 3 and 4.

Figure 3:
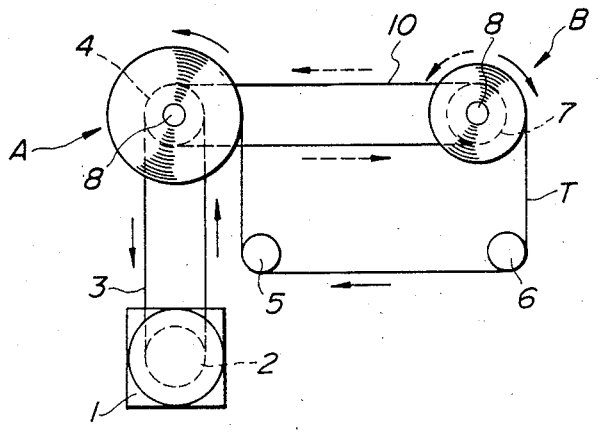
FIG. 3 is a schematic front elevational view of a first embodiment of the winding mechanism according to the present invention.
Figure 4:
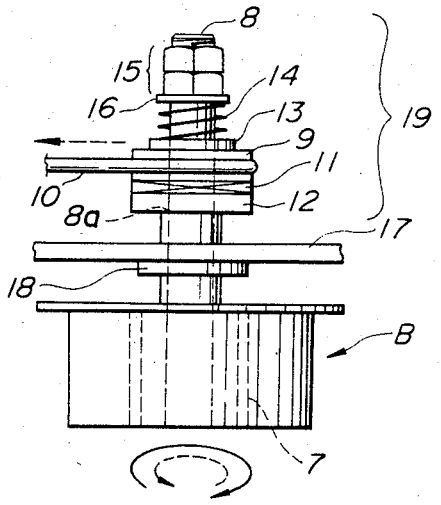
FIG. 4 is an enlarged plan view of the feeding section (delivery side) of the first embodiment, which is provided with a braking device for a rolled tape-like web.

As shown in FIG. 3, in the winding section A, a belt 3 is wrapped around the rotor 2 of an electric motor 1 and around a winding reel 4 carrying a tape-like web T for driving the winding reel 4 by the rotor 2. Both the winding reel 4 in the winding section A and the feeding reel 7 in the feeding section B (delivery side) are interconnected by a transmitting means 10, such as a belt. The tape-like web T in the feeding section B is wound into the winding section A past the turning shafts 6 and 5.

In this first embodiment, a transmitting means 10 and a braking device 19 are provided only in the feeding section B. The feeding reel 7, carrying the tape-like web T on it, is fixed to the shaft 8. The shaft 8 is supported by a fixing plate 17 that has a shaft supporting member 18 on it. The transmitting means 10 is wrapped around a pulley 9 which is supported by the shaft 8. More particularly, on one side face of the pulley 9 are fitted a friction member 11 and a shaft supporting member 12 that is attached to a shoulder 8*a*. On the other side of the pulley 9, a tension spring 14 is interposed between a washer 13 at the pulley and a double nut 15 having a spring supporting flange 16. In this braking device 19, the pressure of the spring 14 is exerted against the pulley 9, friction member 11 and shaft supporting member 12.

The transmitting means 10 between the winding section A and the feeding section B is not restricted to this combination of a pair of pulleys 9 and a belt. Alternately, a combination of a pair of chain wheels and a chain, or the like, can also be employed.

The tape-like web T, which is rolled around the feeding reel 7 in the feeding section B, is wound up by the winding reel 4 in the winding section A, after passing by the turning shafts 6 and 5. In this movement, the transmitting means 10 that passes around the pair of pulleys 9 is moved as indicated by the dashed line arrows in FIG. 3, whereby means 10 exerts a reverse action relative to the movement of the feeding reel 7. The direction of means 10 shown by the dashed line arrows are the reverse of the moving direction shown by solid line arrows of the tape-like web T.

In the above arrangement, sliding frictional force between the member 11 and the shaft supporting member 12, is produced by the force of the spring 14. However, the friction force produced is smaller than the force which feeds the tape-like web T. Thus, the braking effect is obtained.

Figure 5:
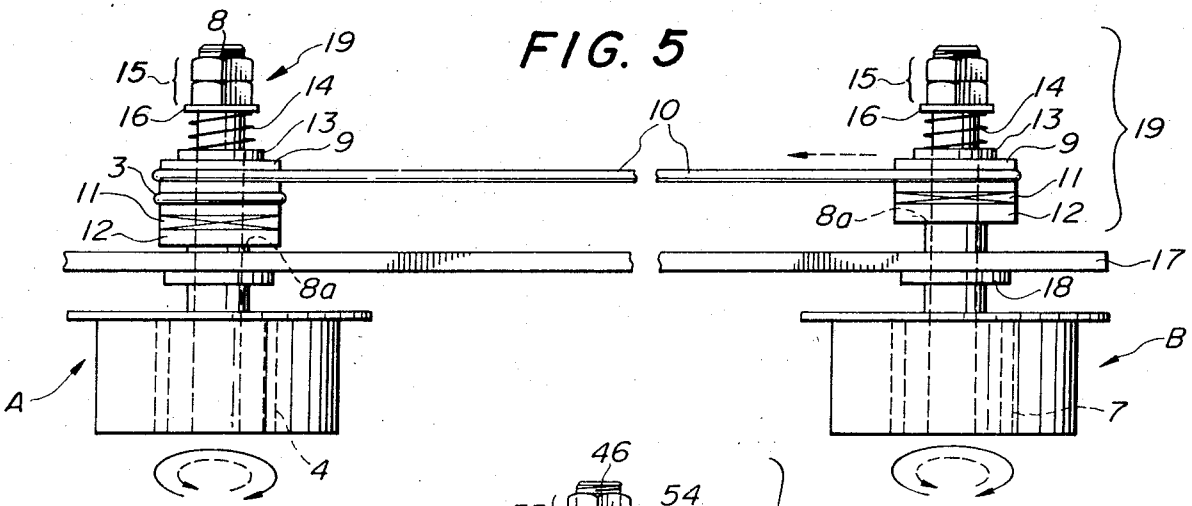
FIG. 5 is an enlarged plan view of a second embodiment of the winding mechanism according to the invention in which both the feeding section and winding section are provided with respective braking devices.

A second embodiment of the present invention is described with reference to FIG. 5.

As in the first embodiment, a transmitting means 10 is provided between the winding section A and the feeding section B. However, each of the winding section A and the feeding section B is provided with a respective braking device 19. Each braking device 19 is the same as that for the feeding section B of the first embodiment and the same parts are indicated by the same reference numerals in FIG. 5. Accordingly, detailed descriptions of them is omitted. In addition, the construction of the winding section A is almost the same as that of the feeding section B. The difference is only that the driving power of the motor 1 is applied only to the pulley 9 in the winding section A by means of a belt 3.

In the present invention as described above, in order to synchronize the rotation of the winding section A with that of the feeding section B, the turning force in the winding section A is partly transmitted to the feeding section B as a rotational force which is reverse to the feeding direction of the tape-like web. And at least two members are urged toward each other by the force of a spring. Accordingly, slackening of a tape-like web due to the intermittent rotation of the winding section can be eliminated. Therefore, the occurrence of slackening and meandering of a tape-like web can be avoided and stable feeding of the tape-like web is accomplished.

Furthermore, with the above combination of the transmitting means and the braking device, smooth braking can be attained irrespective of changes in wound web roll diameters in the feeding section and the winding section.

More particularly, in mechanisms of this kind in the prior art, when the feeding of a rolled tape-like web in the feeding section is started, that is, when the roll diameter in the feeding section is small, the sliding frictional force of the braking in the feeding section is insufficient. When the winding reel is intermittently driven or abruptly stopped, the moment of feeding of the large diameter roll in the feeding section is too large, and this produces excess feeding of the tape-like web causing the undesirable slackening. However, according to the two described embodiments of the present invention, the slackening of the tape-like web can be avoided by the combination of the foregoing transmitting means and the braking device in the feeding section.

When the winding operation comes near its end, the roll diameter in the feeding section becomes small and that in the winding section becomes large so that the sliding frictional force becomes too great, causing excessive braking. A tape-like web is often torn off owing to the force of pulling by the winding roll. According to the present invention, accidents of this kind can also be avoided.

Furthermore, the value of braking force for the braking device in the present invention is generally set to the maximum roll diameter in the feeding section. When the roll diameter in the feeding section is small and the roll diameter in the winding section is large, there is a danger that the tape-like web will be torn off because excess tension is sometimes applied to the tapelike web. In such a case, both the feeding section and the winding section are provided with the foregoing transmitting device and the braking device. Since the braking action is also effected in the winding section, this avoids braking of the tape-like web.

If the value of the braking force is set to a minimum roll diameter in the feeding section, the prevention of slackening according to the present invention cannot be expected, as the braking force becomes too small.

A third embodiment of the invention is now described.

Figure 6:
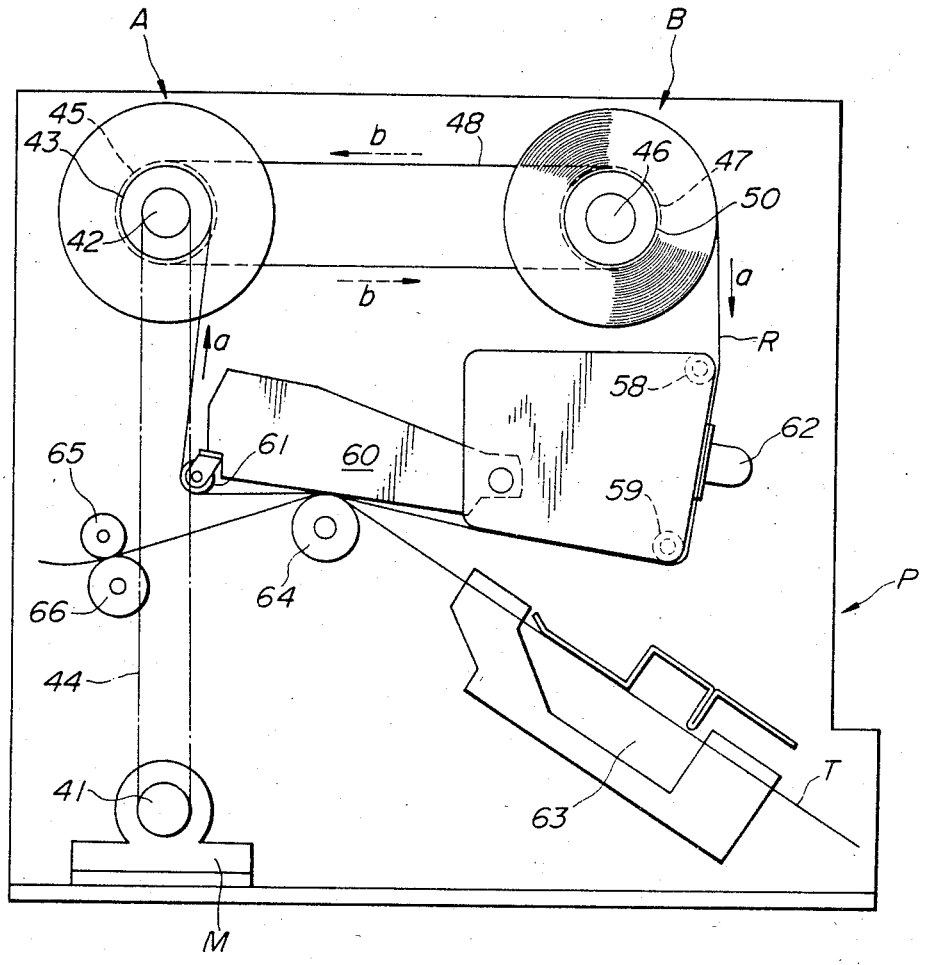
FIG. 6 is a schematic side view of a third embodiment of the anti-meander winding mechanism of the present invention for a carbon ribbon.

In FIG. 6, a stepping motor M is installed, for example, in a thermal printer P. The shaft 41 is connected by a belt 44 to a winding shaft 42 in the winding section A. the rotary power of the rotary shaft 41 is transmitted to the winding shaft 42 and to a winding reel 43.

Figure 7:
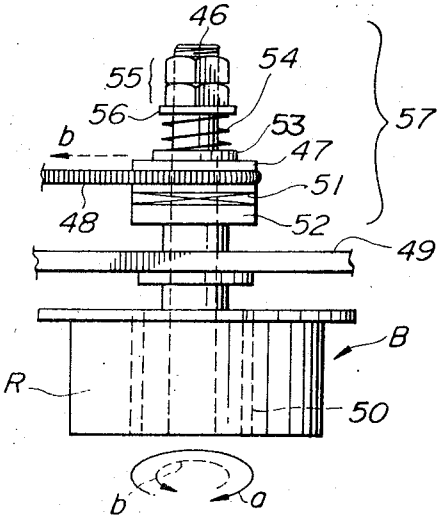
FIG. 7 is an enlarged plan view of the feeding section of the mechanism of FIG. 6, which section is provided with a braking device and a helical spring belt that is stretched between the feeding section and the winding section.

A belt in the form of an elongate continuous helical spring 48 is fitted to the winding pulley 45 in the winding section A and also to a feeding pulley 47 in the feeding section B. This helical spring belt 48 is elastic and gives back tension to the feeding pulley 47. The direction of this tension is the reverse of the direction of feeding of the carbon ribbon R. As shown in FIG. 7, in detail, the feeding pulley 47 is attached to a feeding shaft 46 that is rotatably supported by a fixing plate 49.

A friction member 51 made of felt, or the like material, and a shaft supporting member 52 have a coefficient of friction different from that of the friction member 51, are attached to one side face of the feeding pulley 47. On the other side face of the feeding pulley 47 is disposed a washer 53. Spaced from the washer 53 on the shaft 46 is a double nut 55 having a flange 56. Interposed between the washer 53 and the nut 55 is a spring 54. The force of the spring 54 pushes the feeding pulley 47 toward the friction member 51 and shaft supporting member 52, thereby constituting a braking device 57.

A feeding reel 50 carrying a rolled carbon ribbon R is attached to the shaft 46 in front of the fixing plate 49.

Referring to FIG. 6, with the intermittent rotation of the winding shaft 42 in the winding section A, the carbon ribbon R that is carried on a feeding reel 10 in the feeding section B is wound up in the direction of solid line arrows a. The carbon ribbon R passes to the winding reel 43 past a fixing member, such as a clip, by way of guide rollers 58 and 59 and another guide roller 61 on the printing head 60.

The feeding reel 50 has back tension applied to it, in the direction that is the reverse of the feeding of carbon ribbon R, as shown by dashed line arrows b, by a helical spring belt 48 that is wrapped around the winding pulley 47 in the winding section A and around the feeding pulley 47 in the feeding section B. There is a sensor 22 for the carbon ribbon R. The material T to be printed by the carbon ribbon R is, for example, a composite tag web. The composite tag web T is passed to the surface of the platen roll 64 through a supporting member 63 having a lid. At the platen, the carbon ribbon R is applied as a layer atop the tag web T. Then desired characters are printed on the web T by the printing head 60. The composite tag web T is thereafter guided into a cutting section (not shown) by rollers 65 and 66 to be cut to desired dimensions. The cut pieces are then stored.

As described above, in this embodiment of the present invention, an elastic helical spring belt is stretched between the winding section A and the feeding section B for the carbon ribbon R. This gives back tension through a rotational force that is in the reverse direction to the feeding of the carbon ribbon R. As compared with a rubber belt as described in the prior embodiments herein, the stored energy of the helical spring belt according to the present embodiment eliminates the excess feeding of carbon ribbon that is caused by the inertia of the feeding roll and by the static electricity produced by the sliding contact of the carbon ribbon with the printing head.

The elimination of excess feeding and the absorption of slackening is caused by the tensile force of the helical spring belt which works as a back tension in the direction reverse to the feeding of the rolled carbon ribbon. Accordingly, because excess feeding and the slackening of the carbon ribbon are eliminated, meandering of the carbon ribbon can be effectively avoided. Furthermore, the feeding section is provided with a braking device comprising at least two members which are actuated by a spring.

This maintains the carbon ribbon in a stretched condition, so that stable feeding of the carbon ribbon can be attained.

As described above, when the rolled carbon ribbon R is wound from the feeding section B to the winding section A, a helical spring belt 48 is stretched around a winding pulley 45 and a feeding pulley 47 applies back tension to the feeding section while the braking device 57 operates at the same time. Therefore, the slackening and creasing caused by intermittent feeding and stopping of the carbon ribbon can always be eliminated, thereby avoiding ribbon meandering and enabling the smooth and adequate operation of the carbon ribbon.

With the invention, in a thermal printer, stable feeding of a carbon ribbon can be attained by avoiding the creasing and meandering of the carbon ribbon under one-sided printing strokes.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is;

1. Apparatus for avoiding slackening and for preventing meandering of a rolled, tape-like flexible web, wherein the apparatus comprises:

a feeding section including a web feeding reel for feeding a web and a first means for supporting the web in a first direction around the first supporting means for feeding the web from the feeding reel;

a winding section including a web take-up reel and respective second means for supporting the take-up reel, and the take up reel being rotatable to take up and wind up on it the web feed from the feeding reel;

means for applying a force to rotate take-up reel;

the winding section including transmitting means connected with the feeding reel for applying force to the feeding reel in the direction opposite the unwind direction of the feeding reel and in opposition to a force for moving the feeding reel applied by force being transmitted by the transmitting means being less than said force that is applied by the web, whereby said force applied by the transmitting means does not prevent the web from being fed from the feeding section to the winding section and instead absorbs slack in the web being fed; and a braking device connected with the web for braking the feeding of the web.

2. The apparatus of claim 1, wherein the braking device comprises a driven member and a relatively rotating member which rotates with the movement of the web past the rotating member and with respect to the driven member; and a spring means for urging the relatively rotating and driven members of the braking device together for braking motion of the web therepast.

3. The apparatus of claim 1, in which said braking device comprises a shaft and a shaft supporting member secured to and fixed to said shaft, a driving pulley for said shaft, and a first and a second friction member mounted for rotation relative to said shaft; means driving said friction members together and separating them so that rotation of said shaft in one direction causes the shaft supporting member to rotate in the same direction and so that when said shaft is rotated in the opposite direction, the friction members may slide with respect to each other thereby causing a positive drive in one direction and causing the friction members to slip when the drive is in the opposite direction.

4. The apparatus of claim 1, wherein the braking device is positioned at the feeding reel for braking rotation of the feeding reel.

5. The apparatus of claim 4, further comprising a second one of the braking devices located at the take-up reel for braking the motion of the take-up reel.

6. The apparatus of claim 1, further comprising drive means for driving the take-up reel to rotate; the transmitting means of the winding mechanism also being connected with the drive means for being driven thereby to apply the reverse direction opposition force to the feeding reel.

7. The apparatus of claim 6, wherein the force transmitting means comprises a connection between the take-up reel and the feeding reel for causing the take-up reel to urge the feeding reel to rotate in the direction opposite the direction which feeds off the web from the feeding reel.

8. The apparatus of claim 7, wherein the transmitting means comprises a belt-like connection between the take-up reel and the feeding reel, such that rotation of the take-up reel operates through the transmitting belt-like connection to transmit force for corresponding rotation of the feeding reel.

9. The apparatus of claim 8, further comprising a first pulley on the first supporting means for the feeding reel and connected with the feeding reel for motion therewith; and a second pulley on the second supporting means for the take-up reel and connected with the take-up reel for motion therewith; the belt-like connection being between the first and second pulleys.

10. The apparatus of claim 8, wherein the feeding reel and the take-up reel are so oriented with respect to the web being fed between them that rotation of the take-up reel to draw the web from the feeding reel to the take-up reel causes the feeding reel to rotate in a first direction and the transmitting means is connected between the take-up reel and the feeding reel such that rotation of the take-up reel through the transmitting means urges the feeding reel to rotate in the opposite direction from the direction of rotation thereof for causing the web to be fed therefrom.

11. The apparatus of claim 8, wherein the beltlike connection of the transmitting means comprises a belt generally in the form of a helical spring which is stretched between the feeding reel and the take-up reel wherein the motion of the belt which is caused by the take-up reel urges the feeding reel to rotate in the direction counter to the direction of feed of the web but does not prevent that rotation of the feeding reel which causes feeding of the web.

12. The apparatus of claim 11, further comprising a first pulley on the first supporting means for the feeding reel and connected with the feeding reel for motion therewith; and a second pulley on the second supporting means for the take-up reel and connected with the take-up reel for motion therewith; the belt-like connection being between the first and second pulleys.

13. The apparatus of claim 11, wherein the web is in the form of a carbon ribbon.

14. The apparatus of claim 13, further comprising means for feeding a separate second web to be imprinted, a platen at which the second web is to be imprinted; means for directing the portion of the carbon ribbon passing between the feed reel and the take-up reel over the platen and in contact with the second web and means for causing the imprinting of the second web by the carbon ribbon at the platen.

15. The apparatus of claim 7, wherein the feed reel and the take-up reel are supported on the first and second supporting means and are oriented to cause those reels to rotate in the same direction around generally parallel axes.

16. The apparatus of claim 10, wherein the feed reel and the take-up reel are supported on the first and second supporting means and are oriented to cause those reels to rotate in the same direction around generally parallel axes.

* * * * *